United States Patent [19]

Hampton

[11] Patent Number: 4,601,138

[45] Date of Patent: Jul. 22, 1986

[54] PREFABRICATED ARCHWAY

[76] Inventor: Wade J. Hampton, 3313 N. 68th St., #134E, Scottsdale, Ariz. 85251

[21] Appl. No.: 677,979

[22] Filed: Dec. 4, 1984

[51] Int. Cl.[4] ..... E06B 1/32

[52] U.S. Cl. ..... 52/86; 52/85; 52/211; D25/60

[58] Field of Search ..... 52/85–89, 52/254, 255, 204, 211, 213; D25/60; 405/124–126, 132, 134

[56] References Cited

U.S. PATENT DOCUMENTS

| | | | |
|---|---|---|---|
| 928,265 | 7/1909 | Mahoney et al. | 405/124 |
| 985,539 | 2/1911 | Ottney | 405/124 |
| 1,212,452 | 1/1917 | Caldwell | 405/125 |
| 1,782,147 | 11/1930 | Merryweather | 52/85 |
| 1,886,320 | 11/1932 | Waite | 52/254 |
| 1,999,426 | 4/1935 | Thayer | 52/85 |
| 2,005,572 | 6/1935 | Vass | 52/85 |
| 2,011,796 | 8/1935 | Christensen | 52/85 |
| 2,064,704 | 12/1936 | Vass | 52/85 |
| 3,005,314 | 10/1961 | Cunningham | 405/134 |
| 3,008,273 | 11/1961 | Widin | 52/85 |
| 3,807,105 | 4/1974 | Rudkin, Jr. et al. | 52/86 |
| 4,301,632 | 11/1981 | Wagner | 52/86 |
| 4,490,953 | 1/1985 | Meola | 52/85 |

FOREIGN PATENT DOCUMENTS

| | | | |
|---|---|---|---|
| 3027870 | 3/1982 | Fed. Rep. of Germany | 52/204 |
| 689613 | 4/1953 | United Kingdom | 52/204 |
| 1590298 | 5/1981 | United Kingdom | 52/85 |

*Primary Examiner*—John E. Murtagh
*Assistant Examiner*—Andrew Joseph Rudy
*Attorney, Agent, or Firm*—Fleit, Jacobson, Cohn & Price

[57] ABSTRACT

A prefabricated unitary body forming an archway is made of a light, durable material. The body includes a corner bead and defines a recess for receipt of a corner bead covering a drywall section which abuts against the bottom walls of the archway. The archway is nailed in place and drywall compound is applied, tapering from the corner bead of the archway to fill and cover the seam joining the archway within a framed opening.

21 Claims, 19 Drawing Figures

FIG. 8
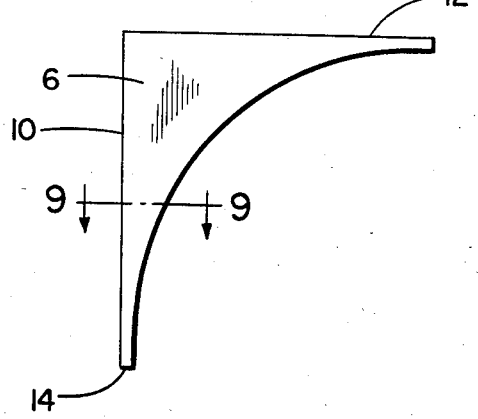
FIG. 9
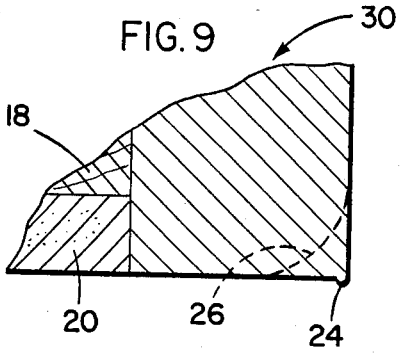
FIG. 10
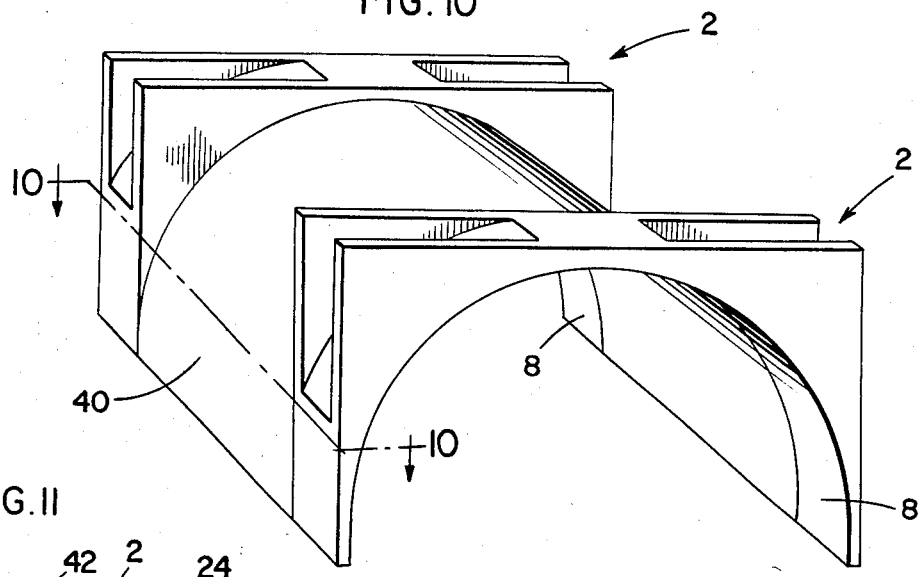
FIG. 11
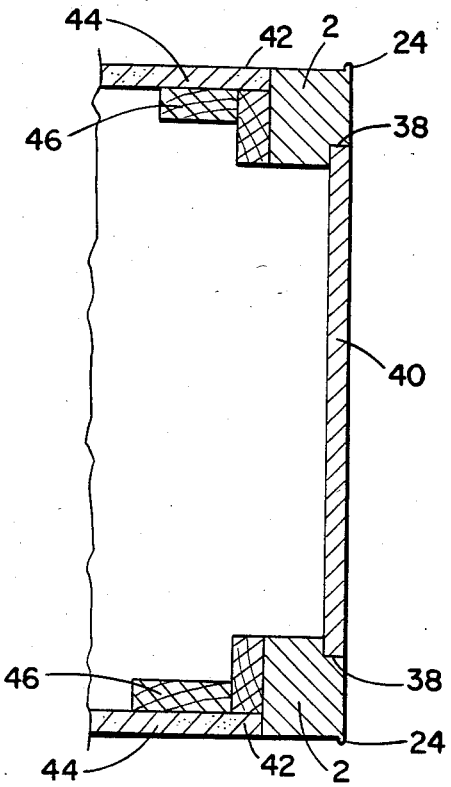
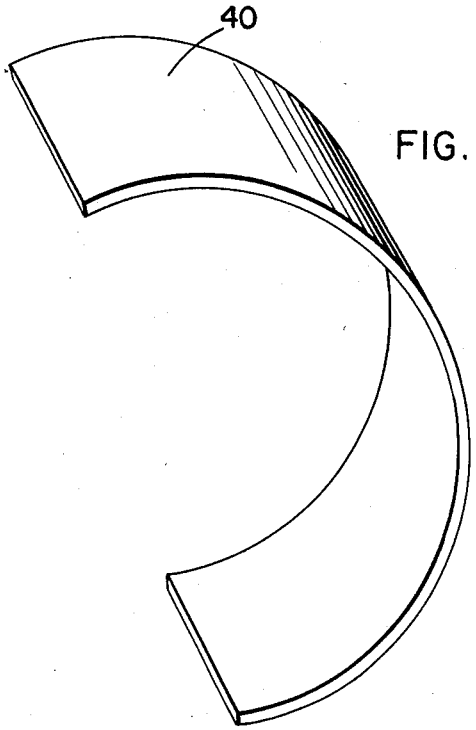
FIG. 12

PREFABRICATED ARCHWAY

BACKGROUND OF THE INVENTION

The prefabricated archway of the present invention is made of a light, durable material. This facilitates quick assembly of archways in door frames or alonq hallways. The cove arch of the present invention is also made of a light, durable material. A cove arch interconnects a ceiling and a side wall or is located at the top of a recessed portion of a wall used for the display of artwork or a statute.

DESCRIPTION OF THE PRIOR ART

Present practice for the construction of an archway includes the laborious task of creating the archway at the job site. Two sheets of plywood are presently cut to the width of a cased opening within which the archway is to be framed. A semi-circle is cut from each piece of plywood to form the boundary of the archway. The two pieces of plywood are spaced from one another a required distance to form the arch. In standard doorway openings, this distance is 4½ inches. If ½ inch plywood is used which will be covered on both sides by ½ inch thick drywall, the plywood pieces are spaced 2½ inches from each other. The space between each of the pieces of plywood is then filled in with numerous support pieces usually cut from two by fours or two by twos which ar secured to both pieces of plywood and extend at their outer face to the periphery of the semi-circles.

In a typical arched doorway, the pieces of ½ inch thick plywood are spaced 2½ inches from each other. Sections of drywall are cut which measure 4½ inches long by 1 inch wide which are then secured to the exposed faces of the two by fours or two by twos and overlap onto the semi-circles of the plywood to form the curve of the arch. Difficulty is usually experienced in securing the drywall to the two by fours or two by twos to form a continuously smooth curve along the exposed face of the support pieces and semi-circles of the plywood forming the archway. Drywall sections of ½ inch width are also applied to the exposed surfaces of the plywood to bring the total width of the archway to 4½ inches.

After the dry wall is secured to the support pieces and exposed face of the plywood, the corner formed between the edges of the drywall and the curves of the drywall secured to the plywood is covered by drywall tape and a metal corner bead is nailed around the edges of the curves. The corner bead is partially cut in a transverse direction at 1 inch intervals to allow for the curving of the corner bead about the edges of the drywall secured to the plywood and sections of drywall on the support pieces. The corner bead, drywall tape and space between adjacent support pieces secured between the plywood is filled in with drywall compound and finished to a smooth surface by sanding. The numerous sections of drywall required to form the archway results in an uneven curve and heavy application of drywall compound is required. The entire proces of assembling and finishing the archway at the job site requires many construction hours.

In U.S. Pat. No. 3,008,273 to Widin, an arch is formed by an arcuate plasterboard panel having side edges engaging a pair of spaced parallel plasterboard panels. The panels have their edges in contact with the panel which is concavely arcuate to conform to the shape of the panel. A corner bead, curved to conform to the shape of the panel and also to the flat surface of the panels, has a plurality of slits cut therein, in spaced parallel relation to permit the corner bead to be curved. Tubular rivets extend through the corner bead and through the panels to secure the panels to the opposite side edges of the arcuate panel. The arcuate panel is formed by a plurality of spaced parallel tranversely extending kerf cuts extending through one side thereof and the plaster with the finished paper being left intact on the opposite side. The panel is then placed over an arcuate form with the curved cuts extending upwardly. In this position, wet plaster is pressed into the curved cuts to completely fill in the curved cuts and provide a plastic surface over the rear face of the panel. Paper tape is then adhered to the plaster to form a smooth finished surface for the panel. The side panels are attached to opposite side edges of the arcuate panel.

In U.S. Pat. No. 2,064,704 to Vass, an arch is formed by assembly of a plurality of parts including first and second U-shaped metal strips having web and outstanding flanges and the outstanding flanges of the second strip being greater in width than the flanges of the first strip. The webs of each strip are placed in abutting face to face relation with the flanges of each strip extending in the same direction. The distance between the webs is equal to twice the thickness of wallboard or other building material. The two strips form arch channels adjacent each edge of the resulting unit for the purpose of receiving the edges of the wallboard. The arch units are made to meet at their upper ends with another arch unit located below a framing member. The wallboard is required to be precut to the shape of an arch and inserted within the channels formed between the strips of different widths. A perforated metal tape is applied over the joint of the wallboards by means of a joint filler cement.

U.S Pat. No. 2,011,796 to Christensen, discloses similar wall sections overlapped on each other so that the complete unit with separate corner beads is adjustable as to width.

U.S. Pat. No. 2,005,572 to Vass discloses archways of reticulated metal which is attached to the framework of a building and forms a firm bond for a plaster coating.

SUMMARY OF THE INVENTION

The prefabricated archway of the present invention is sized to fit various framed openings and thereby quickly facilitates the formation of a uniformly curved archway. Two prefabricated half archway may be used in nonstandard sized framed openings for increasing the width of the arch.

Two full prefabricated archways or four half archways are used for forming archways of greater length than a normal framed doorway and may be spaced from each other at constant intervals over a distance and connected by curved sheets of polyurethane. When a large width and lenqth are required, prefabricated half archways may be used spaced across from another half archway in pairs over a distance, in combination with a flexible sheet.

A prefabricated cove arch is formed from a prefabricated half archway which has had its pointed end sections cut away and corner bead cut off or is prefabricated as a unitary body for interconnecting a ceiling and a side wall.

It is an object of the present invention to provide a prefabricated archway having a body of unitary construction made of a durable, light material.

It is a further object of the present invention to provide a prefabricated cove arch having a body of unitary construction made of a durable, light material.

It is another object of the present invention to form a prefabricated archway with an integral corner bead and recesses defined between its side walls.

It is still another object of the present invention to define recesses located at the ends of the curved section of the archway, shaped complementary to a corner bead which extends from a framed opening which has been covered with drywall, to receive the corner bead in abutting relation with the integral corner bead of the prefabricated archway.

BRIEF DESCRIPTION OF THE DRAWINGS

FIG. 8 is a side view of the prefabricated half archway shown in FIG. 5.

FIG. 9 is a sectional view taken along the sectional line 9—9 shown in FIG. 8.

FIG. 10 is a front perspective view of two of th prefabricated archways shown in FIG. 1 interconnected by a flexible sheet.

FIG. 11 is a sectional view taken along the sectional line 11—11 shown in FIG. 10.

FIG. 12 is a side view of the flexible sheet shown in FIG. 10.

DETAILED DESCRIPTION OF THE PREFERRED EMBODIMENTS

Figure 1:
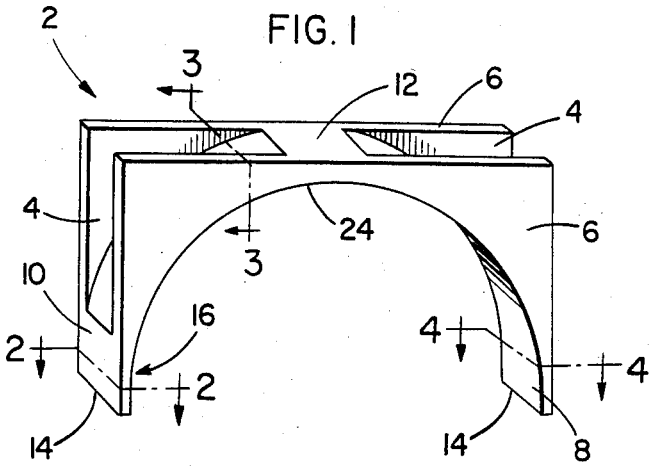
FIG. 1 is a side view of a prefabricated archway.

In FIG. 1, prefabricated archway 2 is shown. The archway is formed of 12 pound density rigid polyurethane foam. The archway 2 is formed by solidifying liquid polyurethane foam placed in a mold defining the outline of the archway 2. The archway includes hollow sections 4, curved section 8, end walls 10, top wall 12 and bottom walls 14.

The archway is made of a unitary body and includes hollow areas 4 defining an opening $3\frac{1}{2}$ inches wide with side walls 6 located on opposite sides of the hollow areas each being $\frac{1}{2}$ inches thick. The combined width of $4\frac{1}{2}$ inches is designed to fit within a standard cased door frame made from two by fours measuring $3\frac{1}{2}$ inches wide with $\frac{1}{2}$ inch thick drywall sections located on opposite sides of the two by fours.

Curved section 8 forms a constant continuous curve of 180° between opposed flat end sections of one-half inch thickness designed to abut and lie flush with one-half inch thick drywall located adjacent to and abutting the bottom walls 14. The angle of curvature can be changed according to the type of arch desired to be formed. The width of the archway 2 tapers down towards the bottom walls 14 which is one-half inch thick across its width. Section 16 of the archway rests on top of and forms a seam with the one-half inch thick plasterboard which covers vertical studs framing the doorway or opening into which the archway is positioned. If $\frac{5}{8}$ inch thick drywall is to be used, the side walls would also measure $\frac{5}{8}$ inch thick as would the bottom walls 14. This assures a continuous, smooth surface from the planar face of the curved section 8 to the abutting drywall sections adjacent to bottom walls 14.

Figure 6:
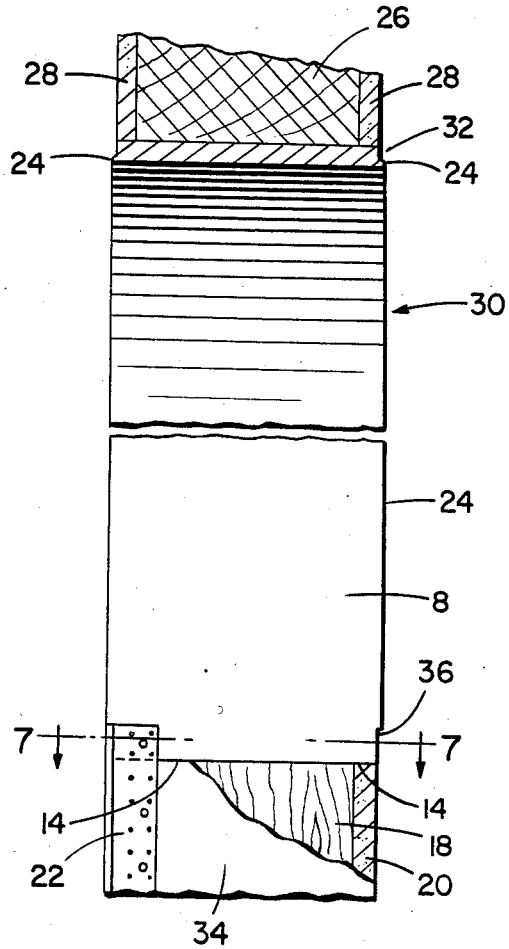
FIG. 6 is an end view taken along the line 6—6 shown in FIG. 5 with a partial sectional view of a supporting side wall.

Both longitudinal edges of the curved section 8 include an integral corner bead 24 as part of the archway body, extending about the longitudinal edges of the curved section 8 until within approximately two inches from the bottom walls 14. The corner bead 24 extends approximately one-eighth of an inch from the curved edges of curved section 8 in the same plane as the planar face of curved section 8. The approximate area of two inches from each bottom wall 14, where the longitudinal edges of the curved section does not include corner bead is designed for mating an abutting section of corner bead extending up along the vertical stud, covered by drywall which forms the cased doorway. This is shown in FIG. 6.

Figure 2:
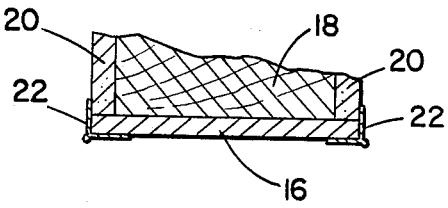
FIG. 2 is a cross-sectional view taken along the lines 2—2 shown in FIG. 1, illustrating a side wall having a layer of plasterboard on two sides with a third side being covered by the prefabricated archway.

In FIG. 2, vertical side wall stud 18 is shown having two pieces of plasterboard 20 attached on opposed sides of the stud 18. The corner bead sections 22 are those which extend vertically and overlap the drywall of the cased doorway and the tapered one-half inch thick bottom section 16 of the archway. In this alignment, the face of the one-half inch thick drywall located on the same stud 18 as the archway, forms a continuous surface with the planar face of the curved section 8.

Figure 4:
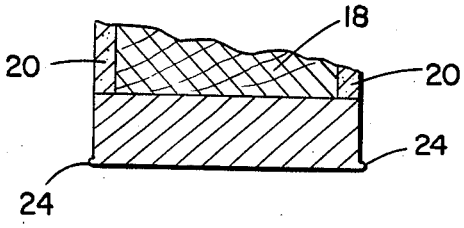
FIG. 4 is a sectional view taken along the sectional line 4—4 shown in FIG. 1.

In FIG. 4, corner bead 24 is integral with the body of the archway and extends about the edges of the curved section 8 a distance of approximately one-eighth of an inch. As in FIG. 6, corner bead 24 of FIG. 4 abuts against corner bead 22 which extends up along the corner of the plasterboard covering the cased doorway opening. In FIG. 4, one of opposed vertical studs 18 is also shown having both sides covered by plasterboard 20. The stud 18 measures $3\frac{1}{2}$ inches across with each section of plasterboard 20 being ½ inch wide, and thereby corresponding to the 4½ inch width of the archway 2 and framed opening. Therefore, with a minimum of time and effort, drywall compound can be applied to the corner bead 24 area and tapered downward over the seam of the archway and the studs 18 and 26 for a smooth finish of the archway. This is done in both the vertical and horizontal directions of the framed opening.

Figure 3:
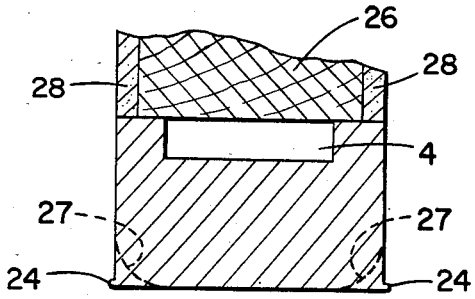
FIG. 3 is a cross sectional view taken along sectional lines 3—3 shown in FIG. 1, illustrating a cross-frame board enclosed by two sheets of plasterboard and the top section of the prefabricated archway.

In FIG. 3, header stud 26 is shown covered by sheets of plasterboard 28. Hollow area 4 is shown as are corner beads 24 which ar integral with the body of the archway. Phantom lines 27 are shown illustrating an alternate embodiment where the corners are removed to form a curved surface for the archway, where a sharp corner edge is not desired. If the corner bead 24 is to be rounded off, this can be done with a router, file or sandpaper to the desired degree of roundness.

The archway 2 shown in FIGS. 1 through 4 is installed by lifting the relatively light, rigid polyurethane foam archway into the opening of a doorway and nailing the archway in place along the curved section 8, near the bottom walls 14 into studs 18 and through the curved section 8 and top wall 12 to header stud 26. The nailheads may be hit until recessed below the surface of the curved section 8 and covered over with drywall compound.

To assist in securing the archway in place, blocks of two by fours, approximately six inches in length are placed below and in a direction parallel with and nailed to the header stud 26. Nails are applied through the side walls 6 into the added pieces of two by four studding. This also helps in maintaining the exact spacial relationship between the side walls 6, preventing any inward curvature of the side walls.

In FIGS. 5 through 12 and 16 through 19, like reference numerals from FIGS. 1 through 4 will be used for like elements.

Figure 5:
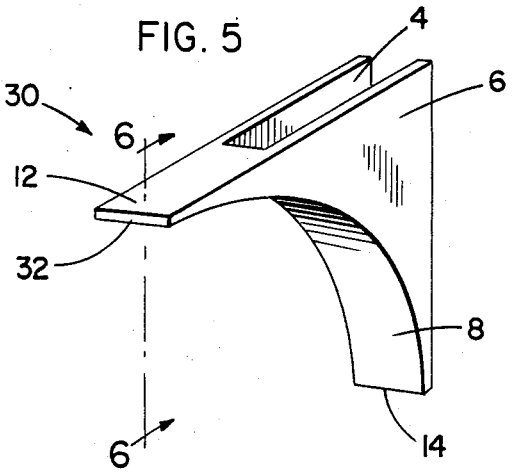
FIG. 5 is a side perspective view of a prefabricated half archway.

In FIG. 5, half archway 30 is shown including side walls 6, curved section 8, top wall 12, bottom wall 14 and end wall 32. The half archway is formed of 12 pound density rigid polyurethane foam. End wall 32, like bottom wall 14 tapers down to a one-half inch thickness so when abutting against a one-half inch thick sheet of drywall, end wall 32 and the drywall will form a continuous surface.

Half archway 30 is used when the archway to be formed is greater than the width of the full archway 2 or can be used to replace single full archway by using two half archways. Opposed half archways 30 may be spaced from one another with a flat piece of one-half inch thick drywall interconnecting respective end walls 32 to form a continuous surface extending from the curved section 8 located on one half archway 30, across the interconnecting drywall section, to an opposed curved section 8 of an opposed half archway 30.

Figure 7:
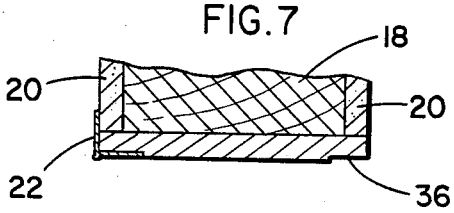
FIG. 7 is a sectional view taken along the sectional line 7—7 shown in FIG. 6.

In FIG. 6, an illustration is provided of the securing of a half archway 30 to a corner of an intersecting vertical stud 18 and horizontal cross beam 26 of a framed opening. Vertical stud 18 is shown with side covering drywall sections 20, as shown in FIG. 2, with another side covered by drywall section 34. Drywall section 34 extends vertically along the face of stud 18 and abuts against the bottom wall 14 of half archway 30. The rear wall 10 of the half archway 30 is flush against vertical stud 18 as is drywall section 34. Corner bead 22 extends parallel to vertical stud 18 and overlaps onto curved section 8, to cover the adjoining edges of drywall section 34 and bottom wall 14. As shown in FIG. 6 and 7, recess 36 allows alignment of corner bead 22 with corner bead 24. The recessing of the corner bead 22 into the half archway 30 lessens the amount of drywall compound needed to smooth over the corner bead of the half archway and corner bead 22 which intersect and abut one another.

As in FIG. 1, FIG. 5 includes hollow area 4 for surrounding a piece of two by four studding secured below and extending in a direction parallel with header 26. FIG. 9 illustrates the abutment of the half archway with the vertical stud 18 and drywall 20. Drywall tape is applied along the intersection of half archway 30 and drywall 20 to cover the seam between the half archway and the drywall. When drywall compound is applied to corner bead 24, the drywall compound is spread out to cover over the tape and the seam formed between the half archway and drywall secured to the beams, forming the framed opening surrounding the archway.

In FIG. 10, two prefabricated archways 2 are shown spaced from one another. This is used where an archway is to be provided along a hallway, corridor or over a width greater than the four and one half inches covered by a single archway 2 when ½ inch drywall is being used. The interior side wall edge of each archway 2 is cut to define a notch 38, as shown in FiG. 11. The notch preferably measures five-eighths of an inch deep by five eighths of an inch wide and extends about one longitudinal edge of the entire curved section 8 of each archway 2. Set inside each notch 38 is one edqe of a curved polyurethane sheet having a thickness of one-half inch. The extra ⅛ inch clearance serves to hold drywall compound used to cover the seam. The polyurethane sheet 40 is secured by adhesive to the interior of the notches. The width of the polyurethane sheet is dimensioned to fit between adjacent archways, typically located two feet apart. The archways 2 are spaced apart to support the polyurethane sheet along its opposite edges.

Half archways 30 shown in FIG. 5, can also be used in combination with the polyurethane sheet 40. The polyurethane sheet is cut to curve along and between spaced apart half archways 30 to follow the curve of the half archways, with flat sections of drywall interconnecting the spaced apart half archways being secured to the ceiling between the half archways.

In FIG. 11, vertical studs 42, in combination with drywall sections 44, define the width of the archway. Respective archways 2 are secured to the vertical studs 42, backed by vertical studs 46, and polyurethane sheet 40 spans between the archways 2 and is aligned flush with the curved sections 8 within recessed notches 38.

Figure 13:
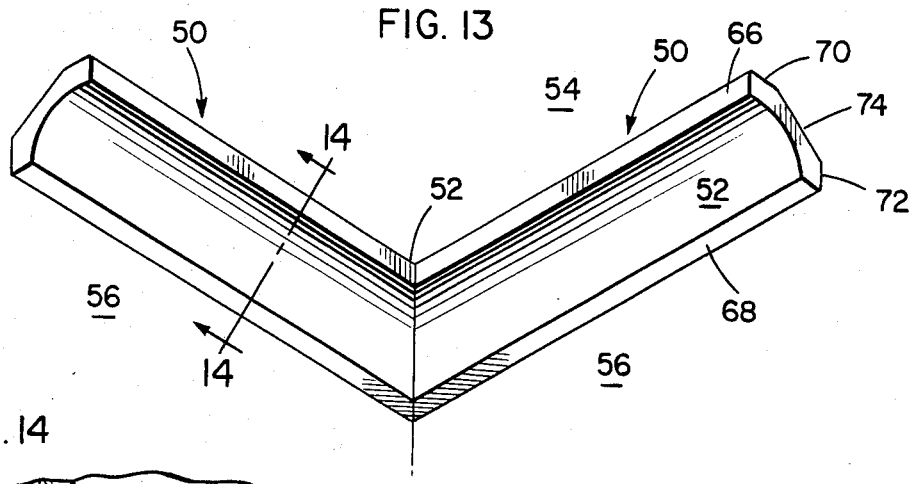
FIG. 13 is a front view of two intersecting cove arch sections.
Figure 14:
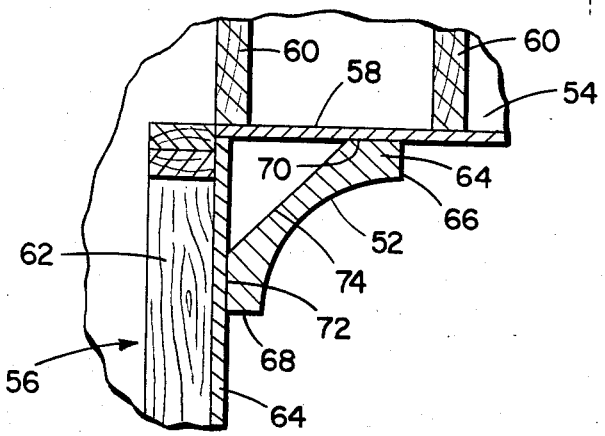
FIG. 14 is a sectional view taken along the sectional line 14—14 shown in FIG. 13.

In FIG. 13, two cove arches 50 are shown intersecting at seam 52. Each cove arch 50 extends between ceiling 54 and a side wall 56. As shown in FIG. 14, plasterboard 58 joining cross beams 60 defines a ceiling 54. Drywall section 64 secured to vertical beam 62 forms a side wall 56. Cove arch 50 includes concavely curved section 52 having flat sections 66 and 68 extending from opposite edges of and parallel to the curved section 52. Section 66 is located perpendicular to section 68. Flat sections 70 and 72 are also located perpendicular to each other and parallel to curved section 52. Sections 70 and 72 extend from sections 66 and 68 respectively. Cross piece 74 interconnects sections 70 and 72. Sections 66, 70 and sections 68, 72 are also located perpendicular to each other. Each cove arch 50 forms a curved molding strip between a ceiling and its side wall or is used as a curved top section for an indented area located in a wall for display of artwork or display of a statute.

Figure 15:
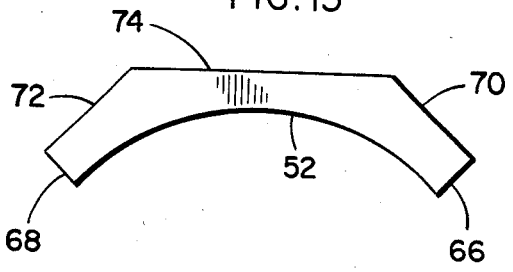
FIG. 15 is a side view of the cove arch shown in FIG. 13.
Figure 16:
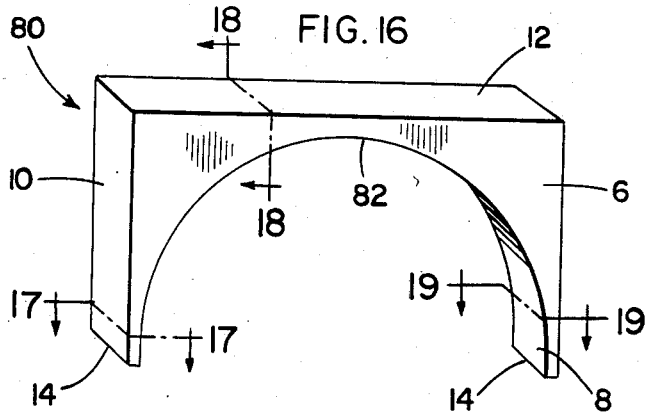
FIG. 16 is a side view of a prefabricated archway, differing from the prefabricated archway shown in FIG. 1.

Cove arch 50 is formed as a unitary body in the form shown in FIG. 13 or can be formed from half archway 30 shown in FIG. 5 by cutting off the corners of the half archway to form the cove archway shown in FIG. 15. A corner bead does not form part of the cove arch due to the desired sharp angling between the curved section 52 and the adjacent sections 66 and 68. A light surfacing of the cove arch with drywall compound is usually done or the cove arch is sanded and painted without any additional surface treatment.

In FIGS. 16 through 19, a prefabricated archway 80 is shown which is similar to the archway 2 shown in FIG. 1. However, in FIG. 16, the archway 80 is formed from a solid piece of styrofoam, expanded synthetic resinous material without the hollow areas 4 shown in FIG. 1. The archway 80 includes curved portion 8, side walls 6, top wall 12, bottom walls 14 and end walls 10. The sides 6 located on opposite sides of the curved section 8 intersect at edge 82 without forming a corner bead. To form the corner bead for the archway 80, a flexible sheet of upsom board is qlued to the curved section 8 of the archway 80.

Figure 17:
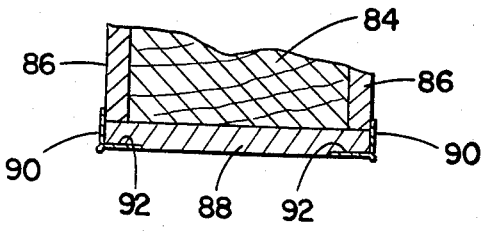
FIG. 17 is a cross-sectional view taken along the sectional line 17—17 shown in FIG. 16, illustrating a side wall having a layer of plasterboard on two sides with a third side being covered by the prefabricated archway shown in FIG. 16.

In FIG. 17, vertical side stud 84 includes two drywall sections 86 secured to opposite sides of the stud 84. A bottom portion 88 of the archway 80 is shown having corner beads 90 located within recesses 92 of the bottom portion 88. The corner beads extend from the plasterboard section located on the side of stud 84 which is common with that of portion 88. The drywall section extends along the stud 84 and abuts against bottom wall 14 of archway 80. The corner beads 90 extend from the drywall section located below bottom wall 14 and overlap onto the bottom portion 88, within the recesses 90 defined by the bottom portion 88.

Figure 18:
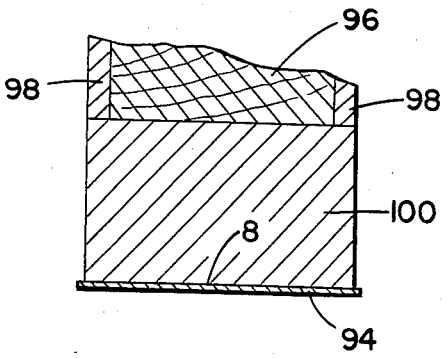
FIG. 18 is a cross-sectional view taken along the sectional line 18—18 shown in FIG. 1, illustrating a crossframe board, enclosed by two sheets of plasterboard, and the top section of the prefabricated archway shown in FIG. 16.
Figure 19:
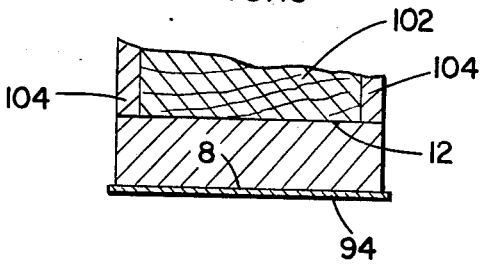
FIG. 19 is a sectional view taken along the sectional line 19—19 in FIG. 16.

To form the corner bead about the edge 82 of the curved section 8 of the archway 80, upsom board 94 is glued to the curved section 8 of the archway 80 as is shown in FIGS. 18 and 19. In FIG. 18, opposed side wall stud 96 is shown with drywall portions 98. Archway section 100 is secured to the stud 96 by nails (not shown) and the upsom board sheet 94 is glued to the curved section 8 of the archway. The upsom board extends from 1/16 to 3/32 of an inch beyond the outer edges of the curved section 8 of the archway 80.

In FIG. 19, header stud 102 includes drywall portions 104 located on opposite sides of the header stud with the top wall 12 attached to the header stud 102 by nails (not shown). The upsom board 94 is cut to extend slightly beyond the edges of the curved section 8 of the archway and drywall compound is applied over the upsom board tapering inwardly toward the seam between the archway and the side wall studs 84, 96 and the header stud 102.

By the present invention, the prefabrication of the archways and cove arch greatly reduces the time, materials and expense of installation of an archway and cove arch. The increased savings over previous archways and cove arches constructed at the job site are enormous and have greatly reduced the amount of construction power required to complete an archway and cove arch with increased quality due to uniform construction.

Having thus described the preferred embodiments of the invention, it should be understood that numerous structural modifications and adaptations may be resorted to without departing from the scope of the appended claims.

I claim:

1. A prefabricated archway attached to a framed opening, said prefabricated archway comprising:

a single body including a curved section being concavely curved and having a planar face defining a curvature of an archway, two side walls extending from said planar face, an exterior surface of each of said two side walls being located continuous with one of opposed longitudinal edges of said planar face, an outer periphery of said two side walls being shaped complementary to said framed opening to space said planar face from said framed opening when said single body is attached within said framed opening so as to form said archway within an opening defined by said framed opening, and a distance between the exterior surfaces of said two side walls when said single body is attached within said framed opening is equal to a width of said framed opening which includes a drywall covering defining exterior surfaces of said framed opening so as to align said exterior surfaces of said framed opening continuous with the exterior surface of said two side walls and continuous with said planar face of said curved section.

2. A prefabricated archway as in claim 1, wherein said single body further includes a top wall equal in width to said curved section and interconnecting said two side walls and being located adjacent to a top of said framed opening when said single body is attached to said framed opening.

3. A prefabricated archway as in claim 1, wherein said single body further includes a corner bead extending from each longitudinal edge of said planar face in a common plane with said planar face.

4. A prefabricated archway as in claim 3, wherein said corner bead extends from said planar face, beyond each of said two side walls a distance in a range of 1/16 to $\frac{1}{8}$ of an inch.

5. A prefabricated archway as in claim 1, wherein two single bodies form an archway.

6. A prefabricated archway as in claim 1, further comprising a curved sheet shaped complementary to said planar face and being attached to said planar face, said curved sheet extending beyond the longitudinal edges of said planar face.

7. A prefabricated archway as in claim 6, wherein said unitary body is formed from expanded synthetic resinous material.

8. A prefabricated archway as in claim 1, further comprising at least one recess defined by said single body being located along said longitudinal edge of said planar face and extending from an end of said planar face.

9. A prefabricated archway as in claim 1, wherein said single body is formed of rigid polyurethane foam.

10. A prefabricated archway attached within a framed opening, said prefabricated archway comprising:

a single body including a curved section having a planar face defining a curvature of an archway, side wall means extending normal to said planar face, an exterior surface of said side wall means extending from a longitudinal edge of said planar face, an outer periphery of said side wall means being shaped complementary to said framed opening to space said planar face from said framed opening when said single body is attached within said framed opening so as to form said archway within an opening defined by said framed opening, and a width of said planar face when said single body is attached within said framed opening is equal to a width of said framed opening which includes a drywall covering defining exterior surfaces of said framed opening so as to align said exterior surfaces of said framed opening continuous with said exterior surface of said side wall means and continuous with said planar face of said curves section.

11. A prefabricated archway as in claim 10, wherein said single body further includes a top edge located adjacent to a top of said framed opening when said single body is attached to said framed opening.

12. A prefabricated archway as in claim 10, wherein said single body further includes a corner bead extending from said longitudinal edge of said planar face in a common plane with said planar face.

13. A prefabricated archway as in claim 10, wherein two single bodies form an archway.

14. A prefabricated archway as in claim 10, wherein said unitary body is formed from expanded synthetic resinous material.

15. A prefabricated archway as in claim 10, wherein said single body is formed of rigid polyurethane foam.

16. A prefabricated archway attached within a framed opening, said prefabricated archway comprising:

a single body including a curved section having a planar face defining a curvature of an archway, a side wall extending normal to said planar face, an exterior surface of said side wall extending from a longitudinal edge of said planar face, an outer periphery of said side wall being shaped complementary to said framed opening to space said planar face from said framed opening when said single body is attached within said framed opening so as to form an archway within an opening defined by said framed opening, and a width of said planar face when said single body is attached within said framed opening is equal to a width of said framed opening which includes a drywall covering defining exterior surfaces of said framed opening so as to align said exterior surfaces of said framed opening continuous with said exterior surface of said side wall and continuous with said planar face of said curved section.

17. A prefabricated archway as in claim 16, wherein said single body further includes a top edge located adjacent to a top of said framed opening when said single body is attached to said framed opening.

18. A prefabricated archway as in claim 16, wherein said single body further includes a corner bead extending from said longitudinal edge of said planar face in a common plane with said planar face.

19. A prefabricated archway as in claim 16, wherein two single bodies form an archway.

20. A prefabricated archway as in claim 16, wherein said unitary body is formed from expanded synthetic resinous material.

21. A prefabricated archway as in claim 16, wherein said single body is formed of rigid polyurethane foam.

* * * * *